US010421214B2

(12) United States Patent
Orban et al.

(10) Patent No.: US 10,421,214 B2
(45) Date of Patent: Sep. 24, 2019

(54) MULTI-PROCESS MIXER FOR WELL FLUID PREPARATION

(71) Applicant: Schlumberger Technology Corporation, Sugar Land, TX (US)

(72) Inventors: Jacques Orban, Katy, TX (US); Brian Rogers, Houston, TX (US); Joel Rondeau, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 510 days.

(21) Appl. No.: 14/928,840

(22) Filed: Oct. 30, 2015

(65) Prior Publication Data

US 2016/0288368 A1 Oct. 6, 2016

Related U.S. Application Data

(60) Provisional application No. 62/141,551, filed on Apr. 1, 2015.

(51) Int. Cl.

| | |
|---|---|
| ***B28C 5/06*** | (2006.01) |
| ***B28C 5/00*** | (2006.01) |
| ***B28C 5/08*** | (2006.01) |
| ***B28C 7/02*** | (2006.01) |
| ***B01F 5/20*** | (2006.01) |
| ***B01F 3/12*** | (2006.01) |
| ***E21B 21/06*** | (2006.01) |

(52) U.S. Cl.

CPC ..... *B28C 5/006* (2013.01); *B01F 3/1271* (2013.01); *B01F 5/205* (2013.01); *B28C 5/06* (2013.01); *B28C 5/0806* (2013.01); *B28C 7/02* (2013.01); *E21B 21/06* (2013.01)

(58) Field of Classification Search

USPC ..... 366/17

See application file for complete search history.

(56) References Cited

U.S. PATENT DOCUMENTS

| | | | |
|---|---|---|---|
| 4,759,632 | A | 7/1988 | Horiuchi et al. |
| 5,570,743 | A | 11/1996 | Padgett et al. |
| 5,624,182 | A | 4/1997 | Dearing, Sr. et al. |
| 2010/0157720 | A1 | 6/2010 | Woodmansee et al. |
| 2014/0238665 | A1 | 8/2014 | Welker |

*Primary Examiner* — Mark Halpern

(74) *Attorney, Agent, or Firm* — Rachel E. Greene

(57) ABSTRACT

A mixing system and method. The mixing system includes a mixer configured to mix a dry component into a fluid to generate a slurry, one or more pumps coupled with the mixer and configured to deliver the fluid thereto, and a manifold system coupled to the mixer and the one or more pumps. The manifold system includes one or more valves configured to direct the slurry from the mixer. The mixing system is operable in a first mixing mode to mix a first type of the slurry, and the mixing system is operable in a second mixing mode to mix a second type of the slurry. The manifold system is configured to prevent inert mixing of the first and second types of the slurry.

17 Claims, 7 Drawing Sheets

MULTI-PROCESS MIXER FOR WELL FLUID PREPARATION

CROSS-REFERENCE TO RELATED APPLICATIONS

This application claims priority to U.S. Provisional Patent Application having Ser. No. 62/141,551, which was filed on Apr. 1, 2015 and is incorporated herein by reference in its entirety.

BACKGROUND

Mixers are used in the oil and gas industry to prepare drilling mud, brine, and cement slurry. Jet mixers and vortex mixers are two examples of such mixer designs. Different mixers are generally used for the different products, since the slurries produced and time sensitivity of the slurries are generally different. Moreover, the various components of the slurries may be incompatible; for example, the components of the mud may negatively impact the cement, and even small amounts of the mud chemicals mixed into the cement slurry may result in poor cement performance.

Further, the different slurries may be prepared in different manners. In a mud mixer, for instance, drilling mud is prepared by feeding drilling mud to the jet mixer using a centrifugal pump. This creates a suction effect, so that dry chemical dropped into the hopper is drawn into the gooseneck, mixed with liquid ingredients, and then returned to the mud tank. The supply rate of chemicals in the mixer may be in the range of 100 pounds per minutes when provided manually, or up to 1000 pounds/minute when fed by pneumatic conveyance (e.g., as with barite).

Cement slurry generally contains higher concentration of solid components. In some slurries, the water to cement ratio may be 44% by weight. Also, a large amount of cement is called for to perform a cement job. For example, 100 tons of cement may be employed, yielding more than 150 to 200 tons of slurry. The cement job may be time-sensitive, and may be executed so that the cement hardens at the desired point in the wellbore. Accordingly, cement mixing may be performed "on the fly," whereby, for example, two tons of cement powder may be poured in the mixer during the mixing period, e.g., in batches for immediate use. A modified jet mixer may be used, in which water is injected in the jet mixer via a centrifugal pump. The slurry may also be injected in the bowl of the mixer allowing recirculation into the mixer for a potential increase of the slurry density. Such slurry injection in the mixer also increases the mixer vacuum effect so that more cement powder can be entrained into the mixing process.

SUMMARY

Embodiments of the present disclosure may provide a mixing system including a mixer configured to mix a dry component into a fluid to generate a slurry, one or more pumps coupled with the mixer and configured to deliver the fluid thereto, and a manifold system coupled to the mixer and the one or more pumps. The manifold system includes one or more valves configured to direct the slurry from the mixer. The mixing system is operable in a first mixing mode to mix a first type of the slurry, and the mixing system is operable in a second mixing mode to mix a second type of the slurry. The manifold system is configured to prevent inert mixing of the first and second types of the slurry.

Embodiments of the disclosure may also provide a method for operating a mixing system. The method includes mixing a first slurry in a mixer when the mixing system is operating in a first mixing mode, adjusting one or more valves of the mixing system to put the mixing system in a clean-out mode, flushing out the mixing system while the mixing system is in the clean-out mode, adjusting at least one of the one or more valves to put the mixing system in a second mixing mode, after flushing out the mixing system, and mixing a second slurry in the mixer when the mixing system is in the second mixing mode.

It will be appreciated that the foregoing summary is intended merely to introduce a few of the aspects of the present disclosure, which are more fully described below. Accordingly, this summary is not intended to be exhaustive or otherwise limiting on the present disclosure.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the invention herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
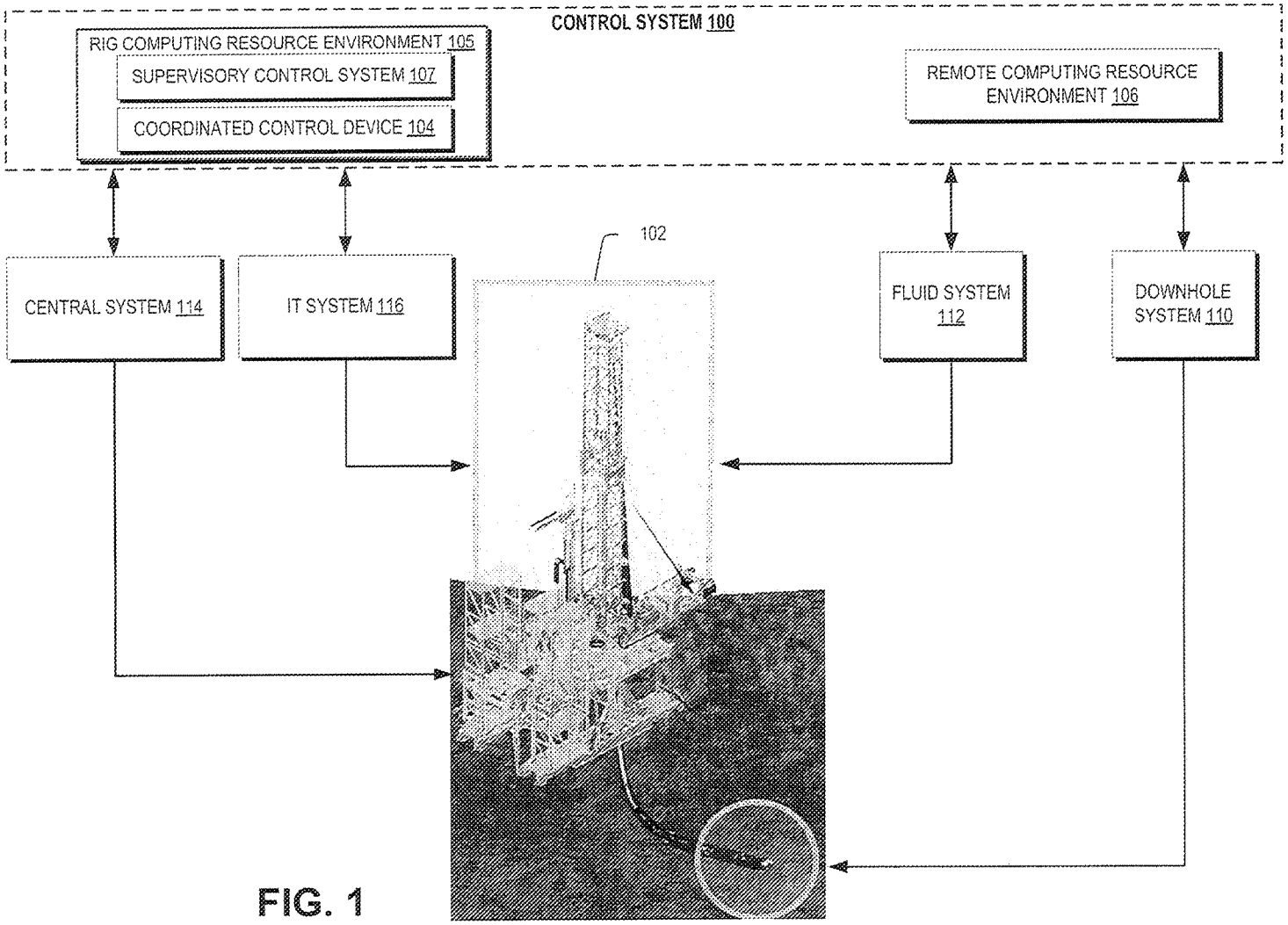
FIG. 1 illustrates a schematic view of a drilling rig and a control system, according to an embodiment.

FIG. 1 illustrates a conceptual, schematic view of a control system 100 for a drilling rig 102, according to an embodiment. The control system 100 may include a rig computing resource environment 105, which may be located onsite at the drilling rig 102 and, in some embodiments, may have a coordinated control device 104. The control system 100 may also provide a supervisory control system 107. In some embodiments, the control system 100 may include a remote computing resource environment 106, which may be located offsite from the drilling rig 102.

The remote computing resource environment 106 may include computing resources locating offsite from the drilling rig 102 and accessible over a network. A "cloud" computing environment is one example of a remote computing resource. The cloud computing environment may communicate with the rig computing resource environment 105 via a network connection (e.g., a WAN or LAN connection). In some embodiments, the remote computing resource environment 106 may be at least partially located onsite, e.g., allowing control of various aspects of the drilling rig 102 onsite through the remote computing resource environment 105 (e.g., via mobile devices). Accordingly, "remote" should not be limited to any particular distance away from the drilling rig 102.

Further, the drilling rig 102 may include various systems with different sensors and equipment for performing operations of the drilling rig 102, and may be monitored and controlled via the control system 100, e.g., the rig computing resource environment 105. Additionally, the rig computing resource environment 105 may provide for secured access to rig data to facilitate onsite and offsite user devices monitoring the rig, sending control processes to the rig, and the like.

Various example systems of the drilling rig 102 are depicted in FIG. 1. For example, the drilling rig 102 may include a downhole system 110, a fluid system 112, and a central system 114. These systems 110, 112, 114 may also be examples of "subsystems" of the drilling rig 102, as described herein. In some embodiments, the drilling rig 102 may include an information technology (IT) system 116. The downhole system 110 may include, for example, a bottom-hole assembly (BHA), mud motors, sensors, etc. disposed along the drill string, and/or other drilling equipment configured to be deployed into the wellbore. Accordingly, the downhole system 110 may refer to tools disposed in the wellbore, e.g., as part of the drill string used to drill the well.

The fluid system 112 may include, for example, drilling mud, pumps, valves, cement, mud-loading equipment, mud-management equipment, pressure-management equipment, separators, and other fluids equipment. Accordingly, the fluid system 112 may perform fluid operations of the drilling rig 102.

The central system 114 may include a hoisting and rotating platform, top drives, rotary tables, kellys, drawworks, pumps, generators, tubular handling equipment, derricks, masts, substructures, and other suitable equipment. Accordingly, the central system 114 may perform power generation, hoisting, and rotating operations of the drilling rig 102, and serve as a support platform for drilling equipment and staging ground for rig operation, such as connection make up, etc. The IT system 116 may include software, computers, and other IT equipment for implementing IT operations of the drilling rig 102.

The control system 100, e.g., via the coordinated control device 104 of the rig computing resource environment 105, may monitor sensors from multiple systems of the drilling rig 102 and provide control commands to multiple systems of the drilling rig 102, such that sensor data from multiple systems may be used to provide control commands to the different systems of the drilling rig 102. For example, the system 100 may collect temporally and depth aligned surface data and downhole data from the drilling rig 102 and store the collected data for access onsite at the drilling rig 102 or offsite via the rig computing resource environment 105. Thus, the system 100 may provide monitoring capability. Additionally, the control system 100 may include supervisory control via the supervisory control system 107.

In some embodiments, one or more of the downhole system 110, fluid system 112, and/or central system 114 may be manufactured and/or operated by different vendors. In such an embodiment, certain systems may not be capable of unified control (e.g., due to different protocols, restrictions on control permissions, safety concerns for different control systems, etc.). An embodiment of the control system 100 that is unified, may, however, provide control over the drilling rig 102 and its related systems (e.g., the downhole system 110, fluid system 112, and/or central system 114, etc.). Further, the downhole system 110 may include one or a plurality of downhole systems. Likewise, fluid system 112, and central system 114 may contain one or a plurality of fluid systems and central systems, respectively.

In addition, the coordinated control device 104 may interact with the user device(s) (e.g., human-machine interface(s)) 118, 120. For example, the coordinated control device 104 may receive commands from the user devices 118, 120 and may execute the commands using two or more of the rig systems 110, 112, 114, e.g., such that the operation of the two or more rig systems 110, 112, 114 act in concert and/or off-design conditions in the rig systems 110, 112, 114 may be avoided.

Figure 2:
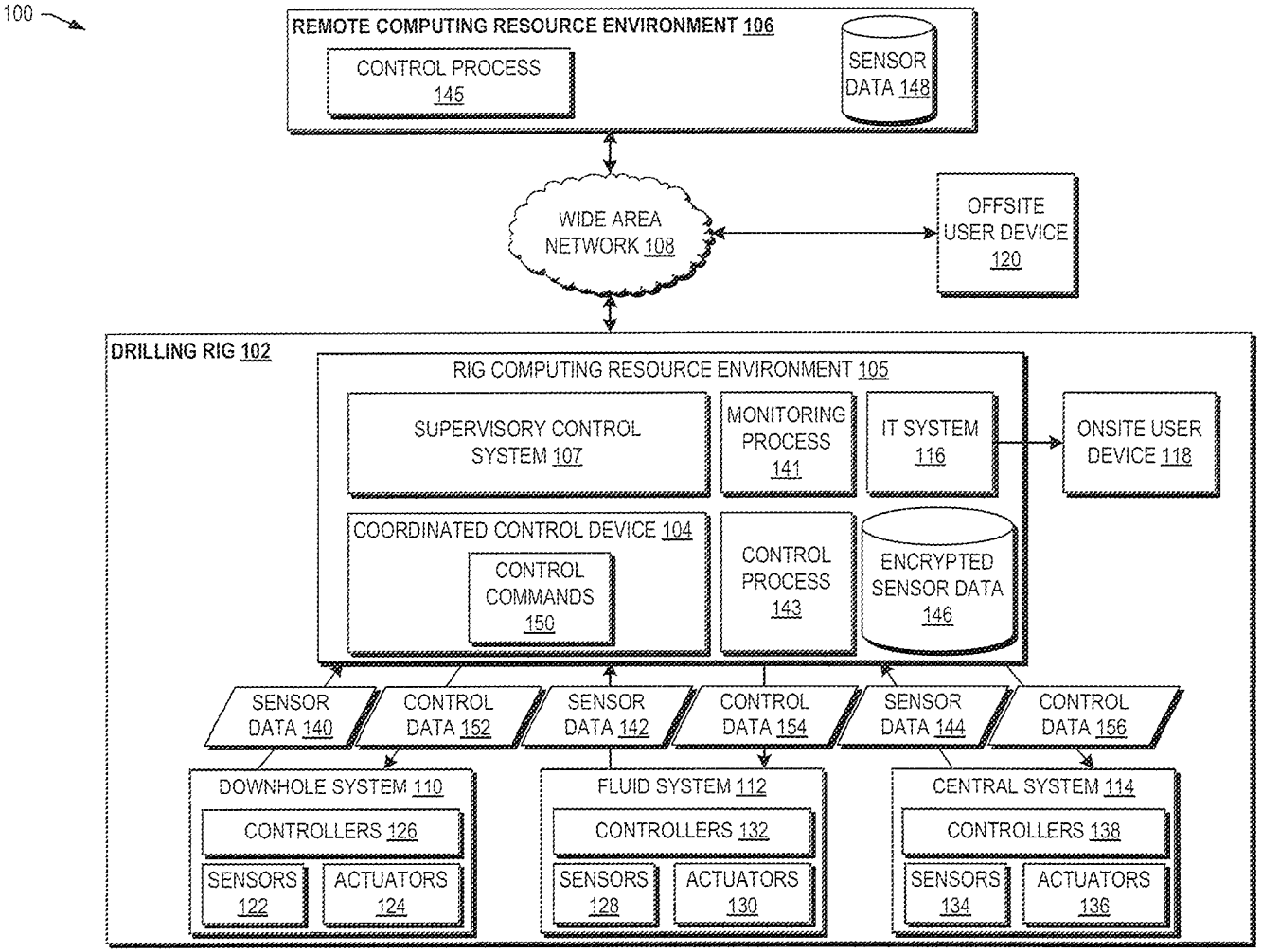
FIG. 2 illustrates a schematic view of a drilling rig and a remote computing resource environment, according to an embodiment.

FIG. 2 illustrates a conceptual, schematic view of the control system 100, according to an embodiment. The rig computing resource environment 105 may communicate with offsite devices and systems using a network 108 (e.g., a wide area network (WAN) such as the internet). Further, the rig computing resource environment 105 may communicate with the remote computing resource environment 106 via the network 108. FIG. 2 also depicts the aforementioned example systems of the drilling rig 102, such as the downhole system 110, the fluid system 112, the central system 114, and the IT system 116. In some embodiments, one or more onsite user devices 118 may also be included on the drilling rig 102. The onsite user devices 118 may interact with the IT system 116. The onsite user devices 118 may include any number of user devices, for example, stationary user devices intended to be stationed at the drilling rig 102 and/or portable user devices. In some embodiments, the onsite user devices 118 may include a desktop, a laptop, a smartphone, a personal data assistant (PDA), a tablet component, a wearable computer, or other suitable devices. In some embodiments, the onsite user devices 118 may communicate with the rig computing resource environment 105 of the drilling rig 102, the remote computing resource environment 106, or both.

One or more offsite user devices 120 may also be included in the system 100. The offsite user devices 120 may include a desktop, a laptop, a smartphone, a personal data assistant (PDA), a tablet component, a wearable computer, or other suitable devices. The offsite user devices 120 may be configured to receive and/or transmit information (e.g., monitoring functionality) from and/or to the drilling rig 102 via communication with the rig computing resource environment 105. In some embodiments, the offsite user devices 120 may provide control processes for controlling operation of the various systems of the drilling rig 102. In some embodiments, the offsite user devices 120 may communicate with the remote computing resource environment 106 via the network 108.

The user devices 118 and/or 120 may be examples of a human-machine interface. These devices 118, 120 may allow feedback from the various rig subsystems to be displayed and allow commands to be entered by the user. In various embodiments, such human-machine interfaces may be onsite or offsite, or both.

The systems of the drilling rig 102 may include various sensors, actuators, and controllers (e.g., programmable logic controllers (PLCs)), which may provide feedback for use in the rig computing resource environment 105. For example, the downhole system 110 may include sensors 122, actuators 124, and controllers 126. The fluid system 112 may include sensors 128, actuators 130, and controllers 132. Additionally, the central system 114 may include sensors 134, actuators 136, and controllers 138. The sensors 122, 128, and 134 may include any suitable sensors for operation of the drilling rig 102. In some embodiments, the sensors 122, 128, and 134 may include a camera, a pressure sensor, a temperature sensor, a flow rate sensor, a vibration sensor, a current sensor, a voltage sensor, a resistance sensor, a gesture detection sensor or device, a voice actuated or recognition device or sensor, or other suitable sensors.

The sensors described above may provide sensor data feedback to the rig computing resource environment 105 (e.g., to the coordinated control device 104). For example, downhole system sensors 122 may provide sensor data 140, the fluid system sensors 128 may provide sensor data 142, and the central system sensors 134 may provide sensor data 144. The sensor data 140, 142, and 144 may include, for example, equipment operation status (e.g., on or off, up or down, set or release, etc.), drilling parameters (e.g., depth, hook load, torque, etc.), auxiliary parameters (e.g., vibration data of a pump) and other suitable data. In some embodiments, the acquired sensor data may include or be associated with a timestamp (e.g., a date, time or both) indicating when the sensor data was acquired. Further, the sensor data may be aligned with a depth or other drilling parameter.

Acquiring the sensor data into the coordinated control device 104 may facilitate measurement of the same physical properties at different locations of the drilling rig 102. In some embodiments, measurement of the same physical properties may be used for measurement redundancy to enable continued operation of the well. In yet another embodiment, measurements of the same physical properties at different locations may be used for detecting equipment conditions among different physical locations. In yet another embodiment, measurements of the same physical properties using different sensors may provide information about the relative quality of each measurement, resulting in a "higher" quality measurement being used for rig control, and process applications. The variation in measurements at different locations over time may be used to determine equipment performance, system performance, scheduled maintenance due dates, and the like. Furthermore, aggregating sensor data from each subsystem into a centralized environment may enhance drilling process and efficiency. For example, slip status (e.g., in or out) may be acquired from the sensors and provided to the rig computing resource environment 105, which may be used to define a rig state for automated control. In another example, acquisition of fluid samples may be measured by a sensor and related with bit depth and time measured by other sensors. Acquisition of data from a camera sensor may facilitate detection of arrival and/or installation of materials or equipment in the drilling rig 102. The time of arrival and/or installation of materials or equipment may be used to evaluate degradation of a material, scheduled maintenance of equipment, and other evaluations.

The coordinated control device 104 may facilitate control of individual systems (e.g., the central system 114, the downhole system, or fluid system 112, etc.) at the level of each individual system. For example, in the fluid system 112, sensor data 128 may be fed into the controller 132, which may respond to control the actuators 130. However, for control operations that involve multiple systems, the control may be coordinated through the coordinated control device 104. Examples of such coordinated control operations include the control of downhole pressure during tripping. The downhole pressure may be affected by both the fluid system 112 (e.g., pump rate and choke position) and the central system 114 (e.g. tripping speed). When it is desired to maintain certain downhole pressure during tripping, the coordinated control device 104 may be used to direct the appropriate control commands. Furthermore, for mode based controllers which employ complex computation to reach a control setpoint, which are typically not implemented in the subsystem PLC controllers due to complexity and high computing power demands, the coordinated control device 104 may provide the adequate computing environment for implementing these controllers.

In some embodiments, control of the various systems of the drilling rig 102 may be provided via a multi-tier (e.g., three-tier) control system that includes a first tier of the controllers 126, 132, and 138, a second tier of the coordinated control device 104, and a third tier of the supervisory control system 107. The first tier of the controllers may be responsible for safety critical control operation, or fast loop feedback control. The second tier of the controllers may be responsible for coordinated controls of multiple equipment or subsystems, and/or responsible for complex model based controllers. The third tier of the controllers may be responsible for high level task planning, such as to command the rig system to maintain certain bottom hole pressure. In other embodiments, coordinated control may be provided by one or more controllers of one or more of the drilling rig systems 110, 112, and 114 without the use of a coordinated control device 104. In such embodiments, the rig computing resource environment 105 may provide control processes directly to these controllers for coordinated control. For example, in some embodiments, the controllers 126 and the controllers 132 may be used for coordinated control of multiple systems of the drilling rig 102.

The sensor data 140, 142, and 144 may be received by the coordinated control device 104 and used for control of the drilling rig 102 and the drilling rig systems 110, 112, and 114. In some embodiments, the sensor data 140, 142, and 144 may be encrypted to produce encrypted sensor data 146. For example, in some embodiments, the rig computing resource environment 105 may encrypt sensor data from different types of sensors and systems to produce a set of encrypted sensor data 146. Thus, the encrypted sensor data 146 may not be viewable by unauthorized user devices (either offsite or onsite user device) if such devices gain access to one or more networks of the drilling rig 102. The sensor data 140, 142, 144 may include a timestamp and an aligned drilling parameter (e.g., depth) as discussed above. The encrypted sensor data 146 may be sent to the remote computing resource environment 106 via the network 108 and stored as encrypted sensor data 148.

The rig computing resource environment 105 may provide the encrypted sensor data 148 available for viewing and processing offsite, such as via offsite user devices 120. Access to the encrypted sensor data 148 may be restricted via access control implemented in the rig computing resource environment 105. In some embodiments, the encrypted sensor data 148 may be provided in real-time to offsite user devices 120 such that offsite personnel may view real-time status of the drilling rig 102 and provide feedback based on the real-time sensor data. For example, different portions of the encrypted sensor data 146 may be sent to offsite user devices 120. In some embodiments, encrypted sensor data may be decrypted by the rig computing resource environment 105 before transmission or decrypted on an offsite user device after encrypted sensor data is received.

The offsite user device 120 may include a client (e.g., a thin client) configured to display data received from the rig computing resource environment 105 and/or the remote computing resource environment 106. For example, multiple types of thin clients (e.g., devices with display capability and minimal processing capability) may be used for certain functions or for viewing various sensor data.

The rig computing resource environment 105 may include various computing resources used for monitoring and controlling operations such as one or more computers having a processor and a memory. For example, the coordinated control device 104 may include a computer having a processor and memory for processing sensor data, storing sensor data, and issuing control commands responsive to sensor data. As noted above, the coordinated control device 104 may control various operations of the various systems of the drilling rig 102 via analysis of sensor data from one or more drilling rig systems (e.g. 110, 112, 114) to enable coordinated control between each system of the drilling rig 102. The coordinated control device 104 may execute control commands 150 for control of the various systems of the drilling rig 102 (e.g., drilling rig systems 110, 112, 114). The coordinated control device 104 may send control data determined by the execution of the control commands 150 to one or more systems of the drilling rig 102. For example, control data 152 may be sent to the downhole system 110, control data 154 may be sent to the fluid system 112, and control data 154 may be sent to the central system 114. The control data may include, for example, operator commands (e.g., turn on or off a pump, switch on or off a valve, update a physical property setpoint, etc.). In some embodiments, the coordinated control device 104 may include a fast control loop that directly obtains sensor data 140, 142, and 144 and executes, for example, a control algorithm. In some embodiments, the coordinated control device 104 may include a slow control loop that obtains data via the rig computing resource environment 105 to generate control commands.

In some embodiments, the coordinated control device 104 may intermediate between the supervisory control system 107 and the controllers 126, 132, and 138 of the systems 110, 112, and 114. For example, in such embodiments, a supervisory control system 107 may be used to control systems of the drilling rig 102. The supervisory control system 107 may include, for example, devices for entering control commands to perform operations of systems of the drilling rig 102. In some embodiments, the coordinated control device 104 may receive commands from the supervisory control system 107, process the commands according to a rule (e.g., an algorithm based upon the laws of physics for drilling operations), and/or control processes received from the rig computing resource environment 105, and provides control data to one or more systems of the drilling rig 102. In some embodiments, the supervisory control system 107 may be provided by and/or controlled by a third party. In such embodiments, the coordinated control device 104 may coordinate control between discrete supervisory control systems and the systems 110, 112, and 114 while using control commands that may be optimized from the sensor data received from the systems 110 112, and 114 and analyzed via the rig computing resource environment 105.

The rig computing resource environment 105 may include a monitoring process 141 that may use sensor data to determine information about the drilling rig 102. For example, in some embodiments the monitoring process 141 may determine a drilling state, equipment health, system health, a maintenance schedule, or any combination thereof. Furthermore, the monitoring process 141 may monitor sensor data and determine the quality of one or a plurality of sensor data. In some embodiments, the rig computing resource environment 105 may include control processes 143 that may use the sensor data 146 to optimize drilling operations, such as, for example, the control of drilling equipment to improve drilling efficiency, equipment reliability, and the like. For example, in some embodiments the acquired sensor data may be used to derive a noise cancellation scheme to improve electromagnetic and mud pulse telemetry signal processing. The control processes 143 may be implemented via, for example, a control algorithm, a computer program, firmware, or other suitable hardware and/or software. In some embodiments, the remote computing resource environment 106 may include a control process 145 that may be provided to the rig computing resource environment 105.

The rig computing resource environment 105 may include various computing resources, such as, for example, a single computer or multiple computers. In some embodiments, the rig computing resource environment 105 may include a virtual computer system and a virtual database or other virtual structure for collected data. The virtual computer system and virtual database may include one or more resource interfaces (e.g., web interfaces) that enable the submission of application programming interface (API) calls to the various resources through a request. In addition, each of the resources may include one or more resource interfaces that enable the resources to access each other (e.g., to enable a virtual computer system of the computing resource environment to store data in or retrieve data from the database or other structure for collected data).

The virtual computer system may include a collection of computing resources configured to instantiate virtual machine instances. The virtual computing system and/or computers may provide a human-machine interface through which a user may interface with the virtual computer system via the offsite user device or, in some embodiments, the onsite user device. In some embodiments, other computer systems or computer system services may be utilized in the rig computing resource environment 105, such as a computer system or computer system service that provisions computing resources on dedicated or shared computers/servers and/or other physical devices. In some embodiments, the rig computing resource environment 105 may include a single server (in a discrete hardware component or as a virtual server) or multiple servers (e.g., web servers, application servers, or other servers). The servers may be, for example, computers arranged in any physical and/or virtual configuration In some embodiments, the rig computing resource environment 105 may include a database that may be a collection of computing resources that run one or more data collections. Such data collections may be operated and managed by utilizing API calls. The data collections, such as sensor data, may be made available to other resources in the rig computing resource environment or to user devices (e.g., onsite user device 118 and/or offsite user device 120) accessing the rig computing resource environment 105. In some embodiments, the remote computing resource environment 106 may include similar computing resources to those described above, such as a single computer or multiple computers (in discrete hardware components or virtual computer systems).

Figure 3:
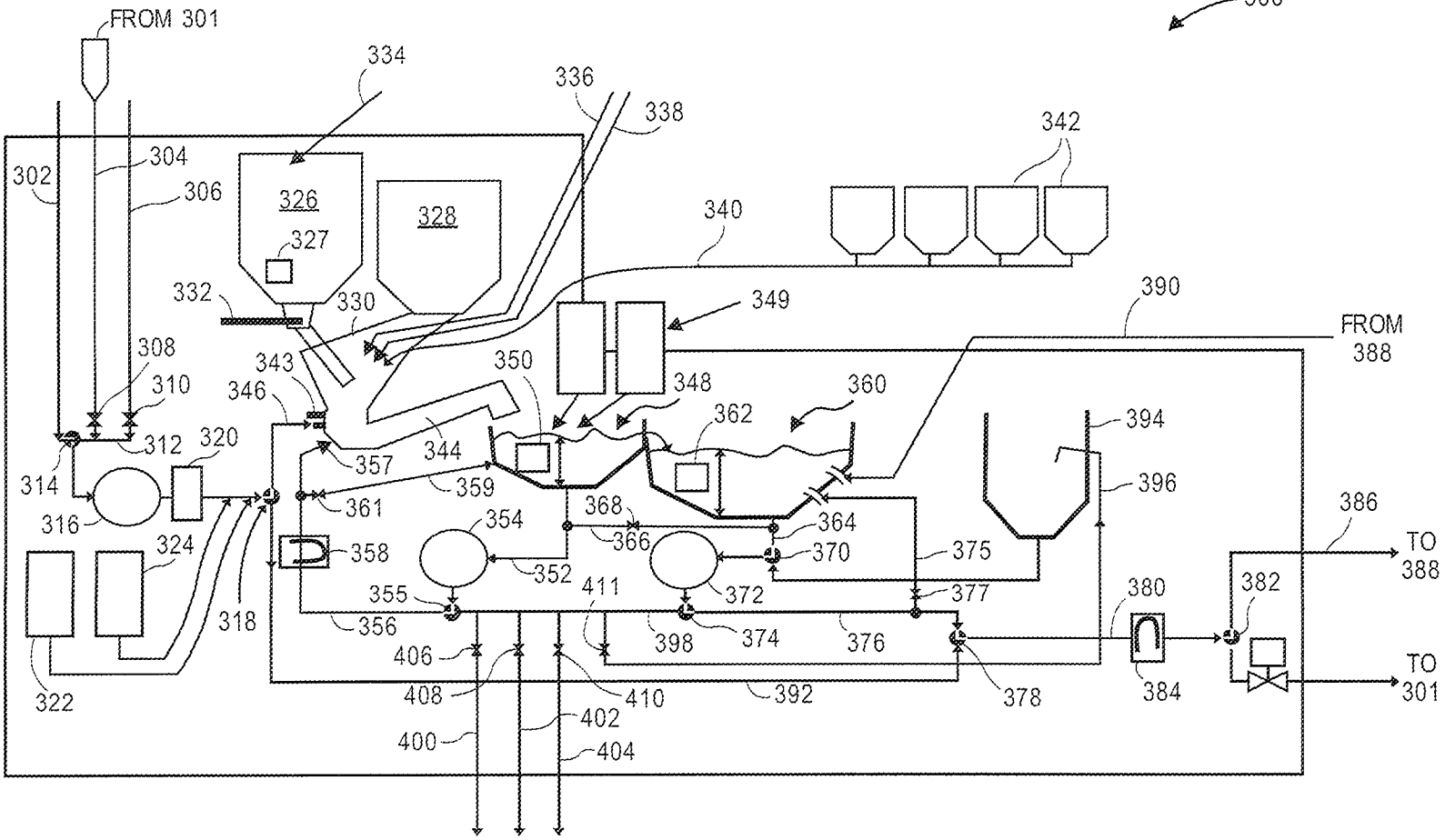
FIG. 3 illustrates a schematic view of a multi-process mixing system in a first mixing mode, according to an embodiment.

FIG. 3 illustrates a schematic view of a multi-process mixing system 300, according to an embodiment. The system 300 may be monitored and/or controlled using the rig control system 100 (FIGS. 1 and 2), as will be described in greater detail below. Further, the system 300 may be adjustable to mix at least two different kinds of slurries, e.g., cement and mud, in response to commands from the rig control system 100. However, in some embodiments, the system 300 may be employed to produce only a single type of slurry, although it may remain capable of producing at least two. As the term is used herein, a "slurry" is any flowable material including a dry component and a liquid component, whether suspended or in solution, homogenously dispersed or not. As the term "fluid" is used herein, it refers broadly to any flowable material, such as a liquid or a slurry, etc., whether having a generally homogenous composition or not.

The illustrated system 300 includes a manifold system configured to supply the slurries to various components of the system 300, without inert mixing. The manifold system may include one or more three-way valves, which may serve to facilitate the avoidance of such inert mixing. In a specific embodiment, the manifold system may include seven three-way valves 314, 318, 355, 370, 374, 378, 382, which are described in the context of their structure and operation in the system 300 below. Although the three-way valves may be referred to herein as a "first" or "second" etc. three-way valve, this naming convention is for purposes of describing the illustrated embodiment of the system 300 and is not to be considered limiting as to the number of three-way valves that may be employed in any given embodiment (e.g., a "second" three-way valve may be provided even in the absence of a "first" three-way valve).

In an example, the use of such three-way valves facilitates direction of fluid in the system 300, and may reduce a risk of error. Further, such valves may replace two single-way valves in the opposite branches of a pipe-T, which may also permit removal of the short branch of the pipe-T. In these short branches, fluid may accumulate and then generate pollution of different fluids pumped afterwards; such pollution may thus be avoided in an embodiment of the manifold system of the mixing system 300. Also, by using such three-way valves, the piping of the mixing system 300 may be cleaned more efficiently. For purposes of description, FIG. 3 illustrates the three-way valves 314, 318, 355, 374, 378, 382 positioned for cement mixing.

Referring to the illustrated embodiment of the mixing system 300 in further detail, the manifold system may include several fluid input or supply lines (three shown: 302, 304, 306). For example, the fluid supply line 302 may receive water from a source, the fluid supply line 304 may receive mud from a source, and the fluid supply line 306 may receive brine from a source. However, in other embodiments, the fluids provided by the individual fluid supply lines 302, 304, 306 may be switched or other fluids may be provided thereby. Further, the fluid supply lines 304, 306 may each include a valve 308, 310, respectively. The valves 308, 310 may each be, for example, a butterfly valve. The valves 308, 310 may be opened or closed by receiving an electrical signal, e.g., from the control system which may be local in mixing system 300 and/or part of the rig control system 100.

The fluid supply lines 302, 304, 306 may connect together at a line 312. The line 312 may include a first three-way valve 314, which may prevent intermixing of the water from the fluid supply line 302 with the mud and brine of the fluid supply lines 304, 306. Moreover, the use of the first three-way valve 314 instead of, for example, a third butterfly valve in the fluid supply line 302 may avoid contamination when the system 300 switches mixing modes, as will be described below, for example, by avoiding the water mixing with mud and brine left in the line 312 when the fluid supply line 302 is opened.

The system 300 may also include a pump 316 downstream from the first three-way valve 314. The pump 316 may be a centrifugal pump in some embodiments, but in others may be any other type of pump. The pump 316 may supply fluid received from the line 312 to a second three-way valve 318. A sensor 320 may be positioned between the pump 316 and the second three-way valve 318, e.g., to measure the flowrate, pressure, etc., of the fluids exiting the pump 316. Furthermore, liquid additives may be introduced into the fluids at a point between the pump 316 and the second three-way valve 318 from one or more liquid additives sources (two are shown: 322, 324). The liquid additives sources (LAS) 322, 324 may be equipped with injection pumps and, e.g., flow meters to control the discharge rate of chemicals. These injection pumps may be programmed to dispense liquid additives for cement mixing and mud production, as will be described below.

The system 300 may also include a surge tank 326, which may be a relatively small gravity silo that acts as a buffer to mitigate the variability of pneumatic transfer of powder via the line 334. The system 300 may also include a dust filter 328. The surge tank 326 and the dust filter 328 may each be coupled with a hopper 330 or any other dry powder receiver.

A sensor 327 may measure a weight of the surge tank 326, or a weight of the contents of the surge tank 326. The surge tank 326 may receive dry cement via line 334 and pressurized air via line 335, and provide at least the dry cement 334 to the hopper 330 or a powder receiver of the system 300 (not shown), past a gate valve 332 positioned at a discharge of the surge tank 326. The gate valve 332 may be used to control the rate of cement fed to the hopper 330 (or the powder receiver). Further, barite and bentonite (or other dry chemicals) may be provided to the hopper 330 (or the powder receiver) via lines 336, 338, which may be direct pneumatic conveyance lines form one or more main storage silos. In addition, chemicals for the production of mud may be received into the hopper 330 via line 340, e.g., from one or more mud chemical silos 342. Additionally, screw conveyors from other silos may be provided, as described in greater detail below. Such lines, conveyors, etc. for delivery of mud chemicals may be referred to individually or collectively as a "mud chemical delivery device."

The system 300 may also include a nozzle 343 and a mixer 344, such as, for example, a jet mixer. The jet mixer 344 may be in selective communication with the surge tank 326 and the lines 336, 338, 340 (and/or the dust filter 328) depending on the mixing mode, as will be described in greater detail below. Further, a line 346 may be connected with the nozzle 343 and may extend from the second three-way valve 318. The nozzle 343 may direct fluids channeled from the second three-way valve 318 via the line 346 into the jet mixer 344. Further, the hopper 330 may be coupled with the jet mixer 344 such that dry chemicals loaded into the hopper 330 (or the powder receiver) fall into the jet mixer 344, e.g., by gravity feed.

The second three-way valve 318 may direct fluid through the line 346 and into the jet mixer 344, where the fluid may mix with cement 334, other dry chemicals, and/or chemicals for making mud, resulting in a slurry. The slurry may then be deposited or otherwise transferred from the jet mixer 344 into a mixing tank 348. A sensor 350 may be positioned in (or above) the mixing tank 348 and may be configured to measure the liquid level in the mixing tank 348. Additionally, a mud liquid additive system (MLAS) 349 may add chemicals to the slurry in the mixing tank 348. The MLAS 349 may be equipped with small pumps and, e.g., flow meters to control the discharge rate of chemical. These small pumps may be programmed for cement mixing and mud production, as will be described below.

Depending on the operating mode, at least some of the slurry in the mixing tank 348 may exit the mixing tank 348 via a first tank exit line 352, and may be delivered to a second pump 354. The flowrate generated by the second pump 354 may be controlled in response to the measurements taken by the liquid level sensor 362, e.g., to avoid cavitating the second pump 354. The second pump 354 may pump the fluid to a third three-way valve 355. In the cement-mixing mode, the three-way valve 355 may direct the liquid from the second pump 354 into a recirculation line 356, which channels the liquid back to the jet mixer 344 via a nozzle 357. A flowrate and fluid density in the recirculation line 356 may be measured by a sensor 358.

Further, a circulation line 359 may extend from the recirculation line 356 back to the mixing tank 348. Flow through the circulation line 359 may be controlled by a valve 361. For example, the valve 361 may be wide open, allowing a high (e.g., highest available) flowrate through the circulation line 359 so as to disperse and homogenize the MLAS 349 contents in the slurry using the energy from the second pump 354.

Another portion of the partially-mixed slurry in the mixing tank 348 may exit the mixing tank 348 and be received into an averaging tank 360. A sensor 362 in (or above) the displacement tank 360 may measure a liquid level therein. The fluid in the displacement tank 360 may exit the averaging tank 360 via a second tank exit line 364. A line 366 may connect with the line 364 and extend to the line 352 via a valve 368. Thus, when the valve 368 is open, at least some of the fluid exiting the averaging tank 360 may be delivered to the second pump 354. Accordingly, the second pump 354 may be employed to control a level of fluid in the averaging tank 360 and/or to further mix fluid or provide additional additives thereto.

The line 364 from the averaging tank 360 may extend to a fourth three-way valve 370. In the illustrated cement-mixing mode, the fourth three-way valve 370 may direct fluid to a third pump 372. The third pump 372 may direct the fluid to a fifth three-way valve 374. In the illustrated cement-mixing mode, the fifth three-way valve 374 may direct the fluid to a line 376 extending to a sixth three-way valve 378. A line 375 may connect with the line 376 and, when a valve 377 thereof is opened, direct at least some of the fluid in the line 376 to the displacement tank 360. The sixth three-way valve 378 may direct fluid via an output line 380 to a seventh three-way valve 382. A sensor 384 may measure the flowrate and/or density of the liquid in the line 380.

In an embodiment, the sensors 384 and 358 may be Coriolis flow meters. In other embodiments, the sensors 384, 358 may measure nuclear absorption of X-rays or gamma-rays in the slurry, or may be a vibrating fork or tube. The sensor 358 may measure at least the density of the slurry, while the sensor 384 may measure at least the density and flowrate. Based on these inputs the speed of the various pumps of the system 300, and/or the feed rate of dry and liquid components may be controlled, e.g., to provide a predetermined density of the slurry.

The seventh three-way valve 382 may direct fluid to a line 386 that channels the fluid to a cement pump 388. The cement pump 388 may be a triplex (e.g., a three piston pump) or any other type of pump. Another line 390 may extend from the cement pump 388 and deliver fluid therefrom to the averaging tank 360. In an embodiment, the line 390 may return fluid from the zone of delivery of the pump 388.

The system 300 may also include a bypass line 392 extending from the second three-way valve 318 to the sixth three-way valve 378. The bypass line 392 may be employed to shunt flow from the inlet to the outlet of the system 300, for example, when providing drilling fluid (e.g., mud) to the pump 388.

The system 300 may further include a fluid separator 394. The fluid separator 394 may be fed a fluid via a line 396. In an embodiment, a dump line 398 may be positioned between the third and fifth three-way valves 355, 374. The dump line 398 may also be connected with one or more clean-out lines 400, 402, 404, which may be controlled via valves 406, 408, 410, respectively. In an embodiment, the clean-out line 400 may lead to a block molding unit, the clean out line 402 may lead to a settling pit, and the clean-out line 404 may lead to a waste disposal. The dump line 398 and one or more of the clean-out lines 400, 402, 404 and/or the fluid separator 394 may be active in a cleaning mode of the system 300, as will be described in greater detail below.

As mentioned above, the system 300 may have two or more mixing modes. Each mode may be controlled according to logic, which may be provided internally, e.g., via a programmable logic controller, or by an external system, such as the rig control system 100. Accordingly, data from the various sensors of the mixer may be fed to such a controller, which may apply the logic of the particular mode that is currently active, and the controller may modulate valve position, pump speed, and/or the like in response.

A first mode of the mixer system 300 may be "on-the-fly" mixing. On-the-fly mixing may be used, for example, in cement mixing. In an embodiment of on-the-fly mixing, water is added via the fluid supply line 302 at a defined rate into the jet mixer 344. This flowrate may be measured by sensor 320, and the speed of the first pump 316 may be adjusted to maintain the rate. The LAS 322, 324 may inject a proportional flowrate of liquid additives into the water. Cement may be fed from the surge tank 326, with the rate being controlled by the gate valve 332, e.g., in response to measurements taken by the sensor 327 or another sensor, indicating the feed rate, concentration, etc. of the cement in the fluid coursing through the mixer 344. The second pump 354 may be used to control recirculation into the jet mixer 344. The mixing tank 348 overflows into the averaging tank 360. The third pump 372 feeds the cement pump 388.

A second mode of the system 300 may be a progressive mixing mode, which, for example, may be employed to raise a chemical concentration in a large volume of mud initially contained in a main mud tank 301. In this mode, the position of the valves 314 and 382 may be reversed. In particular, mud and brine are fed via lines 304 and 306 at a defined rate from the main mud tank 301 into the jet mixer 344 by the pump 316 and measured by the sensor 320. A rate, e.g., relatively small as compared to the on-the-fly mixing mode, of chemicals may be added into the mud via any supply method of chemical (pneumatic conveyance of bentonite, barite, chemical form mini silos) and liquid additive via LAS 322, 324 or MLAS 349.

Once mixed with additives in the tanks 348 and 360, mud may be returned to the main mud tank 301 by operation of the third pump 372 via the valve 374 and the valve 382 (in the reversed position). The level sensor 350 and/or 362 may be used to control the transfer rate of the third pump 372. If the third pump 372 operates at a pre-set RPM, then a control valve (not shown) may be provided.

In the progressive mixing mode, e.g., in a mud mixing application, the mud movement between the mud tank 301 and the mixing system 300 may occur until a pre-defined amount of chemicals has been added. This amount may be monitored either by the flow-measurement of LAS 322, 324 and MLAS 349 or by the load cells on silos and mini-silos thereof.

A third mode of the system 300 may be a batch mixing mode. A pre-defined amount of fluid may be brought in the mixing system tanks via one or more of the fluid supply lines 302, 304, 306 (i.e., the valve 314 may be in the illustrated position or reversed). Then, the chemicals are added via the hopper 330 and/or MLAS 349. When a predetermined amount of chemicals is added, the fluid is transferred out of the mixing system, e.g., via the third pump 372, either back into mud tank 301 or into the well.

For example, for batch mixing cement, LAS 322, 324 discharge rates may be programmed to be proportional with the flowrate of water supplied via line 302 to the mixer 344, as measured by the sensor 320. For addition of chemical in mud, LAS 322, 324 and MLAS 349 may be programmed to deliver a defined volume of chemical in a given period, e.g., corresponding to the handling of a fluid batch. This may be done while batch mixing, with successive transfer (back and forth) of a volume of mud from the mud tank 301 to the mixer system 300. Such volume addition of chemical may be performed until the pre-defined volume of chemical has been added to the mud contained in the main tank.

Another mode of the mixer system 300 may be a clean-out mode. In the clean-out mode, the third and/or fourth three-way valves 355, 374 may, for example, be moved from the illustrated position into a position that allows for flow into the dump line 398. By modulation of the valves 406, 408, 410, the contents of the various lines in the system 300 may be drained or otherwise flushed, e.g., with water. Further, a valve 411 in the dump line 398 may be opened, such that fluid from the second and/or third pump 354, 372 entering the dump line 398 may be routed to the fluid separator 394 via the line 396. A surfactant may be added to the fluid in the fluid separator 394, which may tend to separate the fluid into its component parts, which may include water, diesel, and particulates. Thereafter, the component parts of the fluid may be removed and/or recycled. For example, at least some of the water may be drawn out via line 397 to the valve 370 in the reverse position, and pumped through the pump 372. Thereafter, the valve 374 in the reverse position may direct the fluid to the appropriate line 400, 402, 404 for removal.

Such clean-out mode may be used when switching between different, e.g., incompatible processes, such as switching from mud mixing to cement mixing. In an embodiment, relatively dense cement may be delivered through the line 400 to block molding, which may facilitate removal thereof and reduce waste water treatments.

Figure 4:
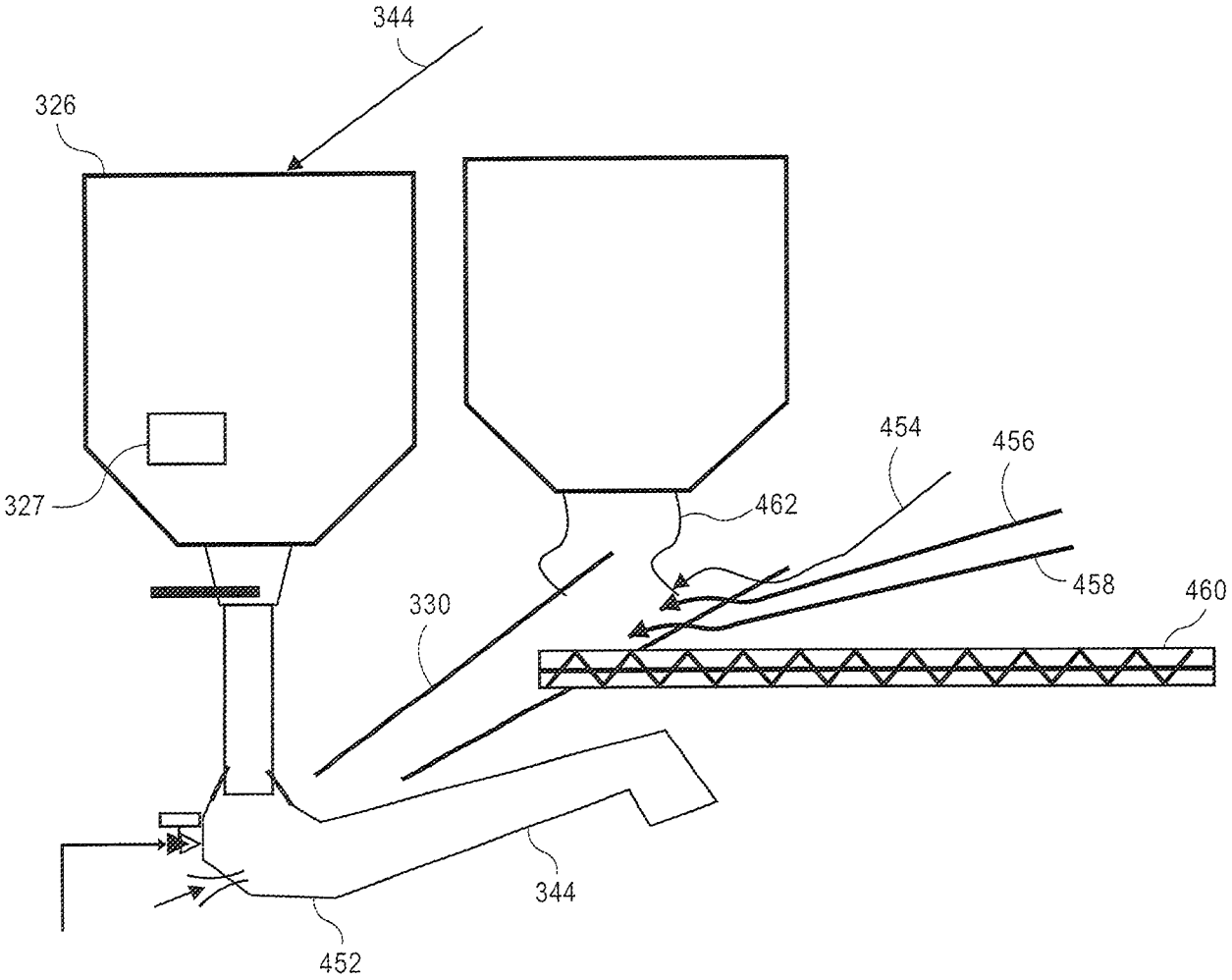
FIG. 4 illustrates a schematic view of a surge tank in the first mixing mode, according to an embodiment.
Figure 5:
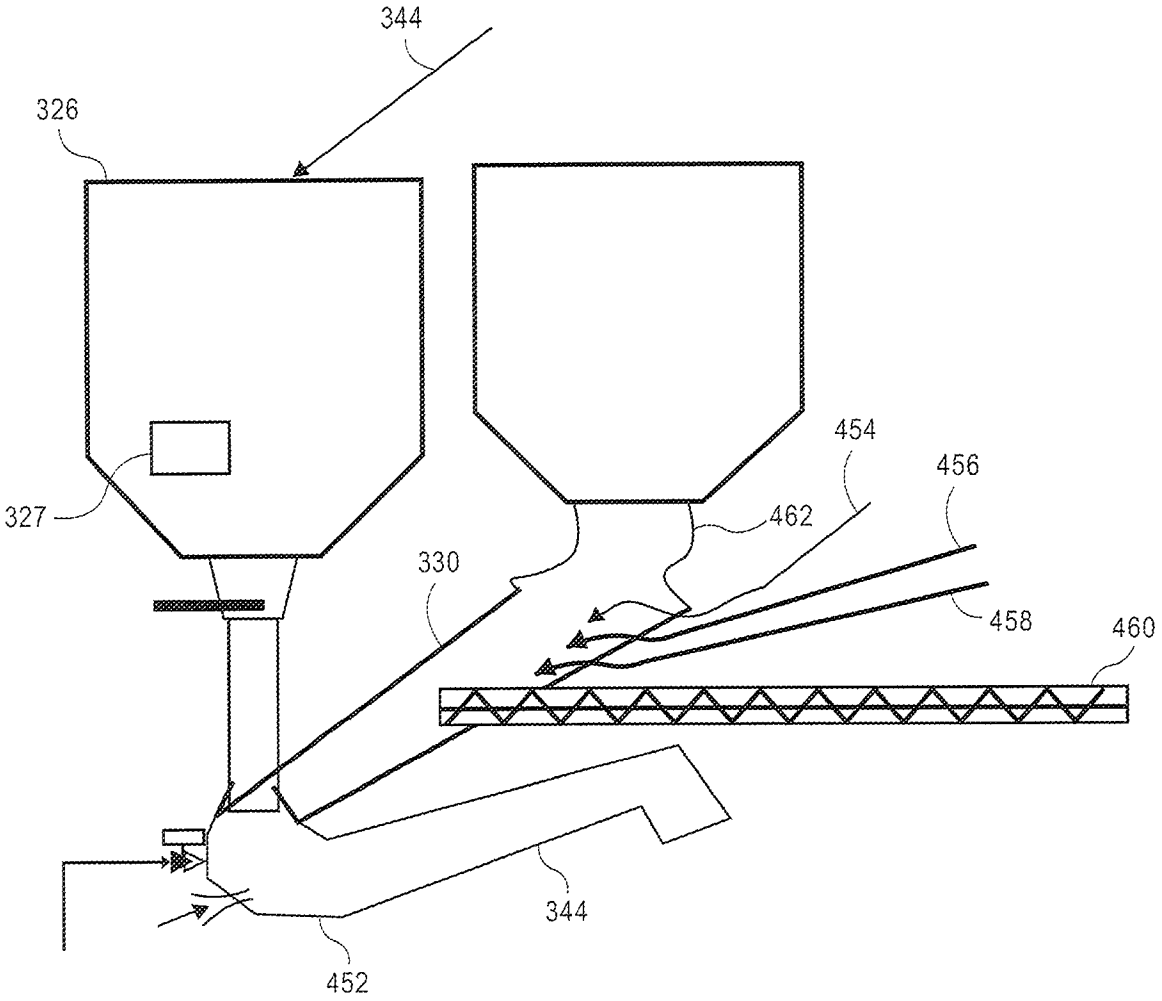
FIG. 5 illustrates a schematic view of the surge tank in a second mixing mode, according to an embodiment.

FIG. 4 illustrates a schematic view of the surge tank 326 mounted above the jet mixer 344 in a first mixing mode, to facilitate high-rate supply (e.g., of cement via line 334) into the jet mixer 344, according to an embodiment. The surge tank 326 may be connected by a pipe or hose onto a bowl 452 of the mixer 344. FIG. 5 illustrates a schematic view of the surge tank 326 mounted above the mixer bowl 452 in a second mixing mode, according to an embodiment.

The first mixing mode may be for mixing cement, and the second mixing mode may be for mixing mud. Thus, when mixing mud, the inclined hopper 330 may be connected to the mixer bowl 452. Several lines (three are shown: 454, 456, 458) may deliver dry materials into the hopper 330, e.g., using pneumatic conveyance. In addition, a screw feeder 460 may deliver other dry materials which are not suited to pneumatic conveyance (such as LCM, fiber, flakes) . The hopper 330 allows simultaneous connection of such lines 454, 456, 458. The chemicals can be simultaneously discharged into the system 300, which may reduce mixing time.

The top of the hopper 330 may be connected to the dust filter 328 via a soft skirt 462 to recover most of the dust from the pneumatic conveyor 459. During a cement job, e.g., in the first mixing mode shown in FIG. 4, cement may be fed into the surge tank 326 from the main cement silo via pneumatic conveyance. The sensor 327 may monitor the weight of the surge tank 326, e.g., to determine the amount of cement inside.

Figure 6:
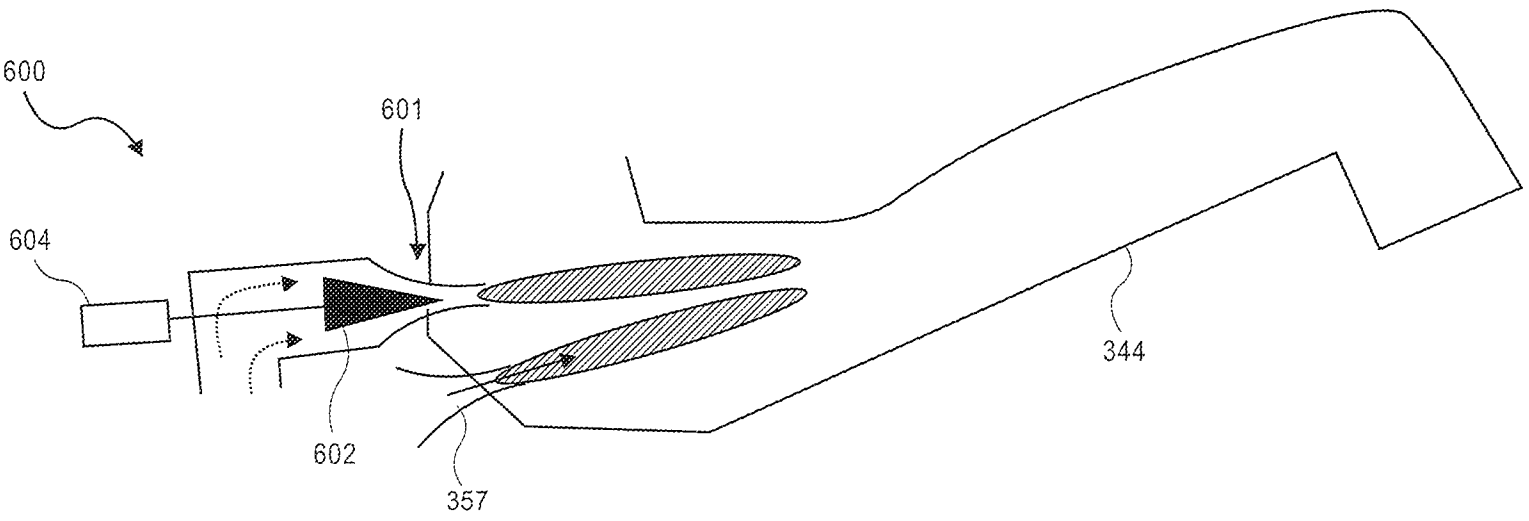
FIG. 6 illustrates a schematic view of a jet mixer, according to an embodiment.

FIG. 6 illustrates a conceptual, schematic view of the jet mixer 344, according to an embodiment. The centrifugal pump 316 (FIG. 3) may feed the fluid into the jet mixer 344 via a controlled choke 600, which may convert the potential fluid energy (pressure) into fluid kinetic energy for high performance jetting into the mixer 344. The available fluid energy may then be used to suck and shear the dry product fed in the mixer 344. In an embodiment, the controlled choke 600 may include a well profile nozzle 601. A mobile choke 602 may move along the axis of the nozzle 601 to restrict the flow area so that the flowrate may be controlled, as the available pressure is limited by the performance of the pump 316. An actuator 604 may generate the movement of the mobile choke 602. Thus, the pump 316 may provide high pressure, while the mobile choke 602 may regulate the flowrate of the supplied fluid (and thus the mixing rate). This may facilitate maintaining the fluid velocity at a generally constant level, independent of the rate of injected water.

Referring additionally to FIG. 3, some of the energy in the fluid generated by the centrifugal pump 316 may be lost in water valves, and some of the feed water in the mixer 344 may not pass through the mixer 344; therefore, the control system may measure the two flowrates (via the sensors 320, 358). In case of variation of recirculation flow, as measured by sensor 358, the nozzle 601 may be adjusted to insure that the sum of the two flow-rates is kept generally constant.

The nozzle 357 may be connected to the centrifugal pump 354, which may recirculate fluid from the mixing tank into the mixer 344. While mixing cement, the circulation line is closed so that the whole recirculation may be performed via the nozzle 357, which may ensure a high vacuum in the mixer, while also providing high transport capability of dry material. Further, the circulation line 359 shown in FIG. 3 may be open for increased homogenization of the fluid in the mixing tank 348 this is the proper setting when operating MLAS 349. Furthermore, the total liquid rate in the mixer may be generally constant, so that the cement entrainment is also generally constant, in view of delivering slurry of constant density.

Figure 7:
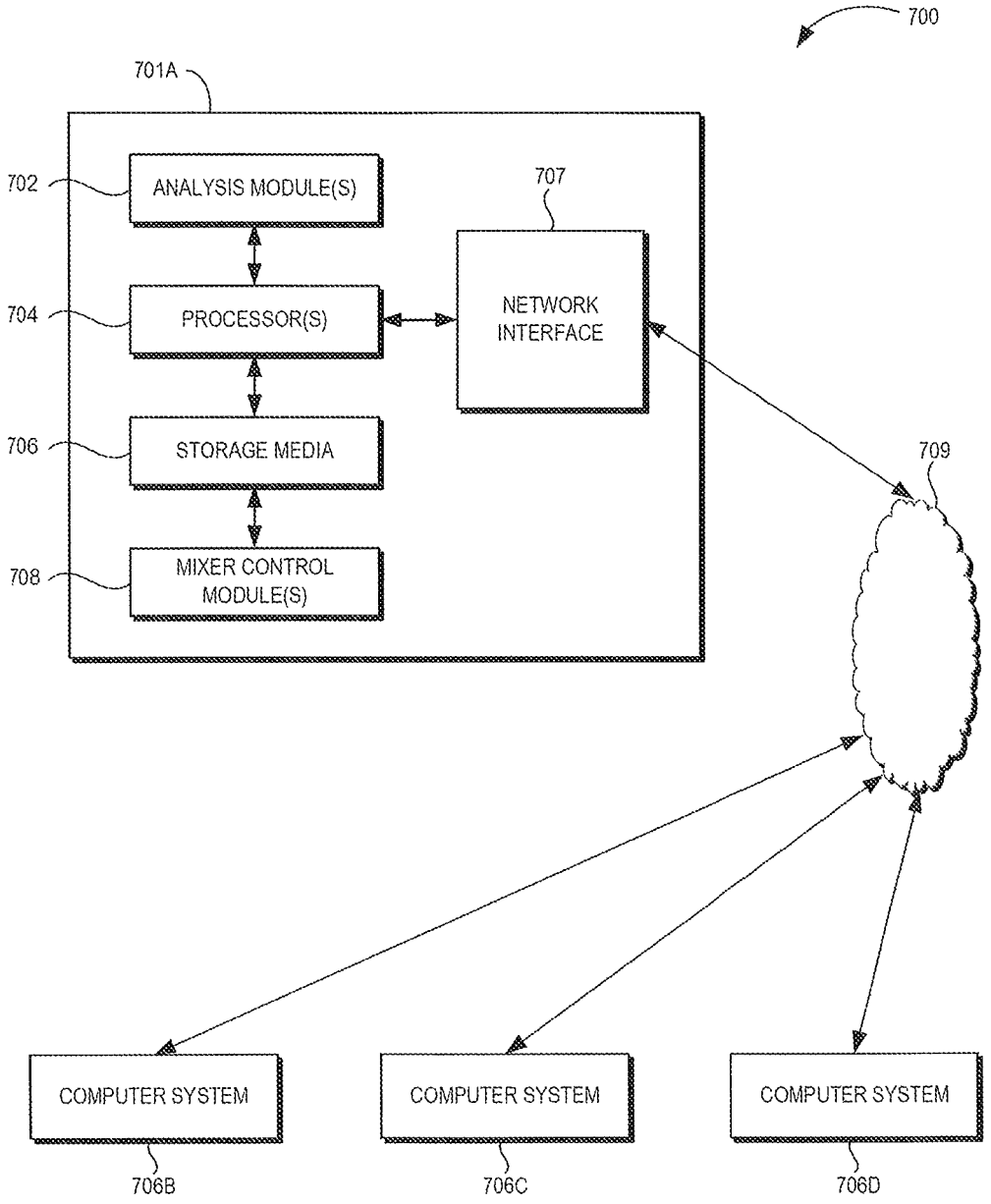
FIG. 7 illustrates a schematic view of a computing system, according to an embodiment.

In some embodiments, the methods of the present disclosure may be executed by a computing system. FIG. 7 illustrates an example of such a computing system 700, in accordance with some embodiments. The computing system 700 may include a computer or computer system 701A, which may be an individual computer system 701A or an arrangement of distributed computer systems. The computer system 701A includes one or more analysis modules 702 that are configured to perform various tasks according to some embodiments, such as one or more methods disclosed herein. To perform these various tasks, the analysis module 702 executes independently, or in coordination with, one or more processors 704, which is (or are) connected to one or more storage media 706. The processor(s) 704 is (or are) also connected to a network interface 707 to allow the computer system 701A to communicate over a data network 709 with one or more additional computer systems and/or computing systems, such as 701B, 701C, and/or 701D (note that computer systems 701B, 701C and/or 701D may or may not share the same architecture as computer system 701A, and may be located in different physical locations, e.g., computer systems 701A and 701B may be located in a processing facility, while in communication with one or more computer systems such as 701C and/or 701D that are located in one or more data centers, and/or located in varying countries on different continents).

A processor may include a microprocessor, microcontroller, processor module or subsystem, programmable integrated circuit, programmable gate array, or another control or computing device.

The storage media 706 may be implemented as one or more computer-readable or machine-readable storage media. Note that while in the example embodiment of FIG. 7 storage media 706 is depicted as within computer system 701A, in some embodiments, storage media 706 may be distributed within and/or across multiple internal and/or external enclosures of computing system 701A and/or additional computing systems. Storage media 706 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 700 contains one or more mixer control module(s) 708. In the example of computing system 700, computer system 701A includes the mixer control module 708. In some embodiments, a single mixer control module may be used to perform some or all aspects of one or more embodiments of the methods disclosed herein. In alternate embodiments, a plurality of mixer control modules may be used to perform some or all aspects of methods herein.

It should be appreciated that computing system 700 is only one example of a computing system, and that computing system 700 may have more or fewer components than shown, may combine additional components not depicted in the example embodiment of FIG. 7, and/or computing system 700 may have a different configuration or arrangement of the components depicted in FIG. 7. The various components shown in FIG. 7 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to explain at least some of the principals of the disclosure and their practical applications, to thereby enable others skilled in the art to utilize the disclosed methods and systems and various embodiments with various modifications as are suited to the particular use contemplated.

What is claimed is:

1. A mixing system, comprising:

a mixer configured to mix a dry component into a fluid to generate a slurry;

one or more pumps coupled with the mixer and configured to deliver the fluid thereto; and a manifold system coupled to the mixer and the one or more pumps, the manifold system comprising one or more valves configured to direct the slurry from the mixer, wherein the mixing system is operable in a first mixing mode to mix a first type of the slurry, wherein the mixing system is operable in a second mixing mode to mix a second type of the slurry, and wherein the manifold system is configured to prevent inert mixing of the first and second types of the slurry.

2. The mixing system of claim 1, wherein the first mixing mode is an on-the-fly mixing mode, and wherein the second mixing mode is a progressive mixing mode.

3. The mixing system of claim 1, wherein the mixing system is further operable in a clean-out mode in which fluid in one or more lines of the manifold system is flushed therefrom.

4. The mixing system of claim 1, wherein the one or more valves of the manifold system comprises a plurality of three-way valves operable to prevent inert mixing of the first and second types of slurry.

5. The mixing system of claim 4, wherein the manifold system comprises:

a first input line coupled with a water source; and a second input line coupled with a mud source, wherein the first and second lines are coupled with a first three-way valve of the plurality of three-way valves, wherein the first three-way valve is fluidly coupled with a first pump of the one or more pumps, and wherein the first three-way valve directs water from the first input line to the first pump when the mixing system is in the first mixing mode, and the first three-way valve directs mud from the second input line to the first pump when the mixing system is in the second mixing mode.

6. The mixing system of claim 5, further comprising:

a sensor positioned downstream from the first pump and upstream from the mixer; and one or more liquid additive systems configured to deliver one or more liquid additives to a point in the manifold system that is downstream from the sensor and upstream from the mixer, wherein the one or more liquid additive systems are configured to deliver the one or more liquid additives at a rate determined based at least in part on a measurement taken by the sensor.

7. The mixing system of claim 1, further comprising:

a surge tank in selective communication with the mixer, to provide dry cement thereto when the mixing system is in the first mixing mode, wherein the surge tank is prevented from communication with the mixer when the mixing system is in the second mixing mode; and a mud chemical delivery device in selective communication with a source of additives for mixing with mud, the mud chemical delivery device being coupled with the mixer when the mixing system is in the second mixing mode, and being prevented from communicating with the mixer when the mixing system is in the first mixing mode.

8. The mixing system of claim 7, further comprising a dust filter in selective communication with the mixer, wherein the dust filter is in communication with the mixer when the mixing system is in the second mode, and is prevented from communication therewith when the mixing system is in the first mode.

9. The mixing system of claim 7, further comprising:

a gate valve configured to control a feed rate from the surge tank to the mixer; and a sensor configured to measure data a density of the slurry in the manifold system, wherein a position of the gate valve is adjusted in response to the data measured by the sensor.

10. The mixing system of claim 1, further comprising:

a mixing tank configured to receive the slurry from the mixer;

an averaging tank configured to receive at least a portion of the slurry from the mixing tank; and one or more mud liquid additive systems configured to add a liquid additive to the slurry in the mixing tank when the mixing system is in the second mixing mode.

11. The mixing system of claim 10, wherein the manifold system comprises a first tank exit line coupled with the mixing tank and configured to receive at least a first portion of the slurry therefrom, and a second tank exit line coupled with the averaging tank and configured to receive at least a second portion of the slurry therefrom, the system further comprising:

a second pump coupled with the first tank exit line and configured to pump the first portion of the slurry therein to the mixer, the mixing tank, or both; and a third pump coupled with the second tank exit line and configured to pump the second portion of the slurry therein to an outlet line of the mixing system.

12. The mixing system of claim 11, further comprising a liquid level sensor in the mixing tank, wherein a flow of fluid and dry powder in the mixer is adjusted based on a level of liquid sensed by the liquid level sensor.

13. The mixing system of claim 11, further comprising a liquid level sensor in the averaging tank, wherein a flowrate of the second portion of the slurry pumped in the third pump is at least partially determined based on a measurement taken by the liquid level sensor.

14. The mixing system of claim 11, further comprising:

a first density meter positioned downstream from the second pump;

a second density meter positioned downstream from the third pump; and a controller that is in communication with the first and second density meters to receive measurement data therefrom, wherein the controller is configured to compare the measurement data from the first and second density meters to determine a density of the first portion of the slurry, the second portion of the slurry, or both.

15. The mixing system of claim 11, wherein the manifold system further comprises a second three-way valve positioned downstream from the second pump, wherein the second three-way valve is configured to direct the first portion of the slurry from the second pump to the mixer, the mixing tank, or both when the mixing system is in the first mixing mode and when the mixing system is in the second mixing mode, and wherein the second three-way valve is configured to direct the first portion of the slurry from the second pump to a dump line when the mixing system is in a clean-out mode.

16. The mixing system of claim 15, wherein the manifold system further comprises a third three-way valve positioned downstream from the third pump, wherein the third three-way valve is configured to direct the second portion of the slurry from the third pump to the outlet line when the mixing system is in the first mixing mode and when the mixing system is in the second mixing mode, and wherein the third three-way valve is configured to direct the second portion of the slurry from the third pump to the dump line when the mixing system is in the clean-out mode.

17. The mixing system of claim 16, further comprising a fluid separator configured to receive a waste fluid from the dump line and provide a separated fluid to the third pump.

* * * * *